US005915424A

United States Patent [19]

Franks et al.

[11] Patent Number: 5,915,424

[45] Date of Patent: Jun. 29, 1999

[54] GUIDE TOOL FOR GUIDING A HARNESSING DEVICE UNDERNEATH A PLURALITY OF WIRES DISPOSED ON A HARNESS BOARD

[75] Inventors: John R. Franks, Hopkinton; John Earley, Northboro, both of Mass.

[73] Assignee: Avery Dennison Corporation, Pasadena, Calif.

[21] Appl. No.: 08/976,972

[22] Filed: Nov. 24, 1997

[51] Int. Cl.[6] ..... B21F 27/08

[52] U.S. Cl. ..... 140/92.1; 29/755; 53/589; 269/903

[58] Field of Search ..... 29/755; 53/589, 53/592; 100/25; 140/92.1; 269/903

[56] References Cited

U.S. PATENT DOCUMENTS 3,837,691 9/1974 Smythe .
4,335,477 6/1982 Halstead .
4,473,524 9/1984 Paradis .
4,561,349 12/1985 Grenon .
4,711,071 12/1987 Kägi .
5,430,996 7/1995 Kurmis .
5,522,436 6/1996 Tabuchi et al. .

*Primary Examiner*—Lowell A. Larson
*Attorney, Agent, or Firm*—Kriegsman & Kriegsman

[57] ABSTRACT

A one-piece guide tool for use in guiding a harnessing device underneath a plurality of wires disposed on a harness board. The guide tool comprises an elongated body having a top surface on which the plurality of wires can be seated, a pair of sides and an elongated slot. The elongated slot extends down from the top surface and includes an entry end and an exit end. The elongated slot has a depth sufficient to enable a harnessing device to be guided into the elongated slot from the entry end, underneath the plurality of wires seated on the top surface and then out through the exit end without slipping out of the slot. Each of the sides of the elongated body includes a tab for mounting the guide tool onto the harness board.

6 Claims, 5 Drawing Sheets

GUIDE TOOL FOR GUIDING A HARNESSING DEVICE UNDERNEATH A PLURALITY OF WIRES DISPOSED ON A HARNESS BOARD

BACKGROUND OF THE INVENTION

The present invention relates generally to harness board assemblies and more particularly to tools for installing a harnessing device around a plurality of wires disposed on a harness board.

Harness boards are well known and are commonly used in the automotive industry to position electrical wires, terminals, connectors and the like into a desired configuration. Specifically, electrical wires are positioned on the harness board in the configuration in which the wires will be arranged when installed in an automobile. The wires are temporarily held in place on the harness board by pins and clamps which are affixed to the harness board. In use, after the electrical wires have been disposed on the harness board in a predetermined configuration, a plurality of harnessing devices, such as cable ties, are used to bundle the wires at various locations and thereby hold the wires in the desired configuration.

After a sufficient number of harnessing devices have been used to hold the wires in its desired configuration, the plurality of wires are removed from the harness board while still in its desired configuration and are positioned within the automobile for use. It should be noted that if the plurality of wires are not bundled together properly, the overall configuration of the wires may shift when removed from the harness board. This may prevent the plurality of wires from fitting through the wire insertion holes formed in the automobile, thereby making it impossible to affix the wiring harness to the automobile.

Very often cable ties are used to bundle the plurality of wires in its desired configuration. Commonly, cable ties comprise an elongated strip of material, such as plastic, having a head at one end, a tail at the other end and either teeth or rungs disposed along the length of the strip. Feeding the tail of the tie through the head results in the tie taking the shape of a loop with the tail engaging and being locked in position by a pawl inside the head, the tail being incapable of removal once it is inserted in the head.

It has been found that the act of wrapping the plurality of cable ties around the wires positioned on the harness board is often difficult to perform. In particular, it has been found that it is often difficult for the user to wedge the cable tie underneath the wires and above the harness board sufficiently so as to enable the cable tie to be wrapped around the wires to form a bundle.

Accordingly, various approaches have been made to facilitate the wrapping of bundling devices around wires positioned on a harness board.

For example, in U.S. Pat. No. 5,522,436 to M. Tabuchi et al, there is disclosed a wire harness assembling board and band clamp binding examining device therefor. The wire harness assembling board is provided with positioning members. In binding band clamps by a band clamp binder, the band clamp binder is engaged with the positioning members to position the band clamp binder. If the band clamp binder is engaged with the positioning members, signals are sent to a clamp binding examining device from operating pins through signal lines. In the clamp binding examining device, the signals are counted, to inform a worker of passing when the number of signals becomes a predetermined number. As a result, it is possible to satisfactorily prevent the band clamps from not being bound by the band clamp binder.

In U.S. Pat. No. 5,430,996 to V. Kurmis, there is disclosed a system for arranging and binding an elongated object, especially a cable harness. The arrangement for ordering and binding an elongated object, in particular a cable tree, comprises an ordering device for example a laying board with supports for a cable tree, which determines the position of the object. It also comprises a binding device which binds the object with a tape. To this end, the binding device has a wrapping guide which wraps the tape around the object and a sealing device with a device for joining the ends of the tape. The sealing device can be moved relative to the ordering device so that it can be placed at the various binding sites in the object. According to the invention, at least part of the wrapping guide is arranged on the ordering device, i.e., at each of the binding sites. The sealing device is therefore not attached to the binding device until it is placed on one of the wrapping guides. To this end, the sealing device and the wrapping guide are fitted with co-operating positioning devices.

SUMMARY OF THE INVENTION

It is an object of the present invention to provide a new and improved guide tool for use in guiding a harnessing device underneath a plurality of wires disposed on a harness board.

It is another object of the present invention to provide a guide tool as described above which can be mounted onto the harness board.

It is yet another object of the present invention to provide a guide tool as described above which is one piece.

It is still another object of the present invention to provide a guide tool as described above which has a minimum number of parts, is simple in construction and is easy to use.

Accordingly, there is provided a guide tool for use in guiding a harnessing device underneath a plurality of wires disposed on a harness board, the harnessing device being used to form said plurality of wires into a bundle, said guide tool comprising an elongated body having a top surface on which the plurality of wires can be seated, a pair of sides and an elongated slot, the elongated slot extending down from the top surface and having an entry end and an exit end, the elongated slot having a depth sufficient to enable said harnessing device to be guided into the elongated slot from the entry end, underneath the plurality of wires and then out through the exit end without slipping out of the slot.

There is also provided a method of installing a harnessing device underneath a plurality of wires positioned on a harness board, said method comprising the steps of mounting a guide tool on the harness board, the guide tool comprising an elongated body having a top surface, a pair of sides and an elongated slot, said elongated slot extending down from said top surface and having an entry end and an exit end, positioning the plurality of wires on the harness board, said plurality of wires which pass over the portion of the harness board on which said guide tool is mounted being seated on said top surface of said elongated body, and manually inserting a harnessing device into the elongated slot, said elongated slot having a depth sufficient to enable said harnessing device to be guided into the elongated slot from the entry end, underneath the plurality of wires and then out through the exit end without slipping out of the slot.

Various other features and advantages will appear from the description to follow. In the description, reference is made to the accompanying drawings which form a part thereof, and in which is shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
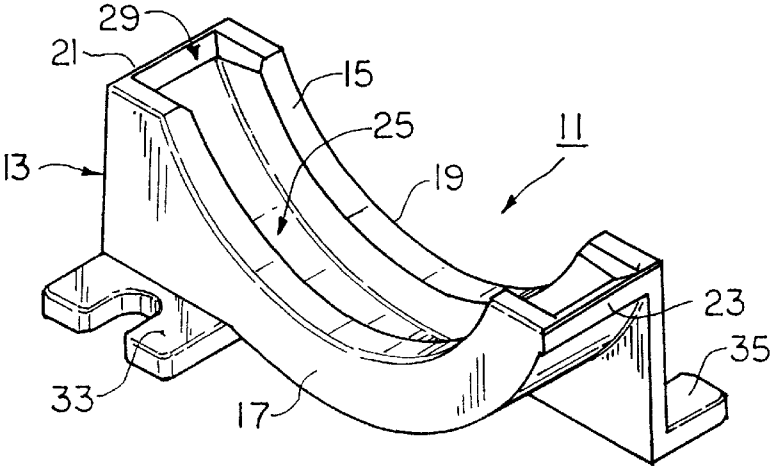
FIG. 1 is a perspective view taken from the top of a first embodiment of a guide tool constructed according to the teachings of the present invention.
Figure 2:
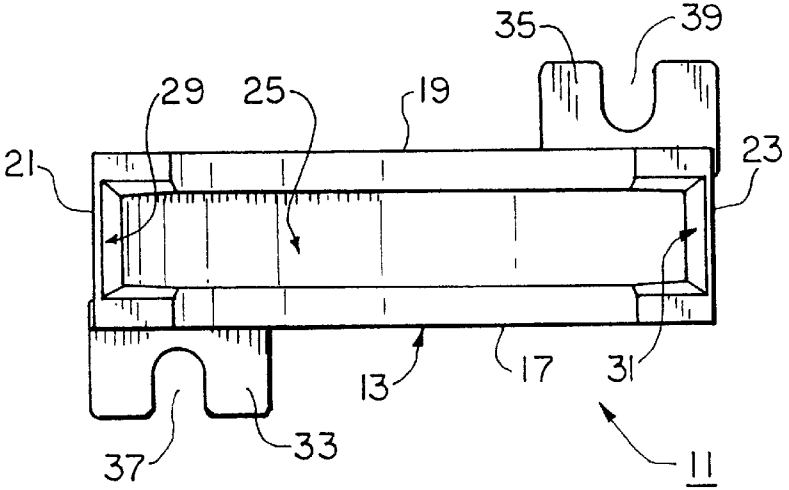
FIG. 2 is a top view of the guide tool shown in FIG. 1.
Figure 3:
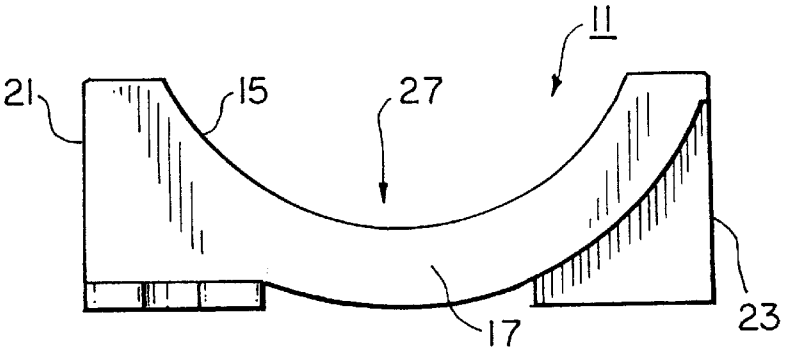
FIG. 3 is a side view of the guide tool shown in FIG. 1.
Figure 4:
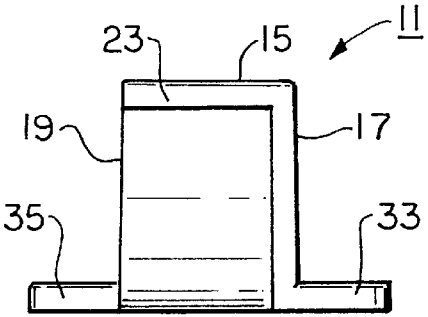
FIG. 4 is a end view of the guide tool shown in FIG. 1.

Referring now to the drawings, there are shown in FIGS. 1–4 a first embodiment of a guide tool constructed according to the teachings of the present invention, the guide tool being identified by reference numeral 11. As will hereinafter be shown in detail, guide tool 11 can be used to guide a harnessing device, such as a cable tie C, underneath a plurality of wires W which are disposed on a harness board B.

Guide tool 11 comprises an elongated, unitary body 13 generally U-shaped in longitudinal cross-section which may be constructed out of a wide range of suitable materials. For example, unitary body 13 may be constructed of a rigid and durable plastic, such as polypropelene or DELRIN. If constructed of plastic, guide tool 11 may be manufactured using conventional molding techniques.

Elongated body 13 comprises a generally U-shaped top surface 15, a first side 17, a second side 19, a first end 21, a second end 23 and an elongated slot 25.

Generally U-shaped top surface 15 is arcuately shaped so as to define a curved recess 27 into which a plurality of wires may be disposed and retained, as will be described in detail below.

Elongated slot 25 extends down from top surface 15 and includes an entry end 29 at first end 21 and an exit end 31 at second end 23. As will hereinafter be shown in detail, elongated slot 25 extends down from top surface 15 at a depth sufficient to enable a cable tie C to be guided into elongated slot 25 from entry end 29, underneath the plurality of wires W and then out through exit end 31 without slipping out of elongated slot 25.

Guide tool 13 additionally comprises a first tab 33 and a second tab 35. First tab 33 is integrally formed to first side 17 at first end 21 and projects out from first side 17 at a right angle. Second tab 35 is integrally formed to second side 19 at second end 23 and projects out from second side 19 at a right angle. First tab 33 is shaped to include an arcuate opening 37. Similarly, second tab 35 is shaped to include an arcuate opening 39. Openings 37 and 39 enable a securing device (not shown), such as a bolt, a pin, a nail or a screw, to be inserted through first and second tabs 33 and 35, respectively, and into harness board B to securely mount guide tool 11 onto harness board B. It should be noted that the securing device may be used to either permanently or temporarily secure guide tool 11 to board B. It should also be noted that instead of employing a securing device, guide tool 11 could alternatively be attached to board B by glue, cement or other similar adhesive.

As can be appreciated, the particular shape of first side 17 and second side 19, as well as the placement of first tab 33 relative to first side 17 and the placement of second tab 35 relative to second side 19, enables a pair of guide tools 11 to be mounted onto harness board B in either a side-to-side or end-to-end relationship.

Figures 5, 6, 7:
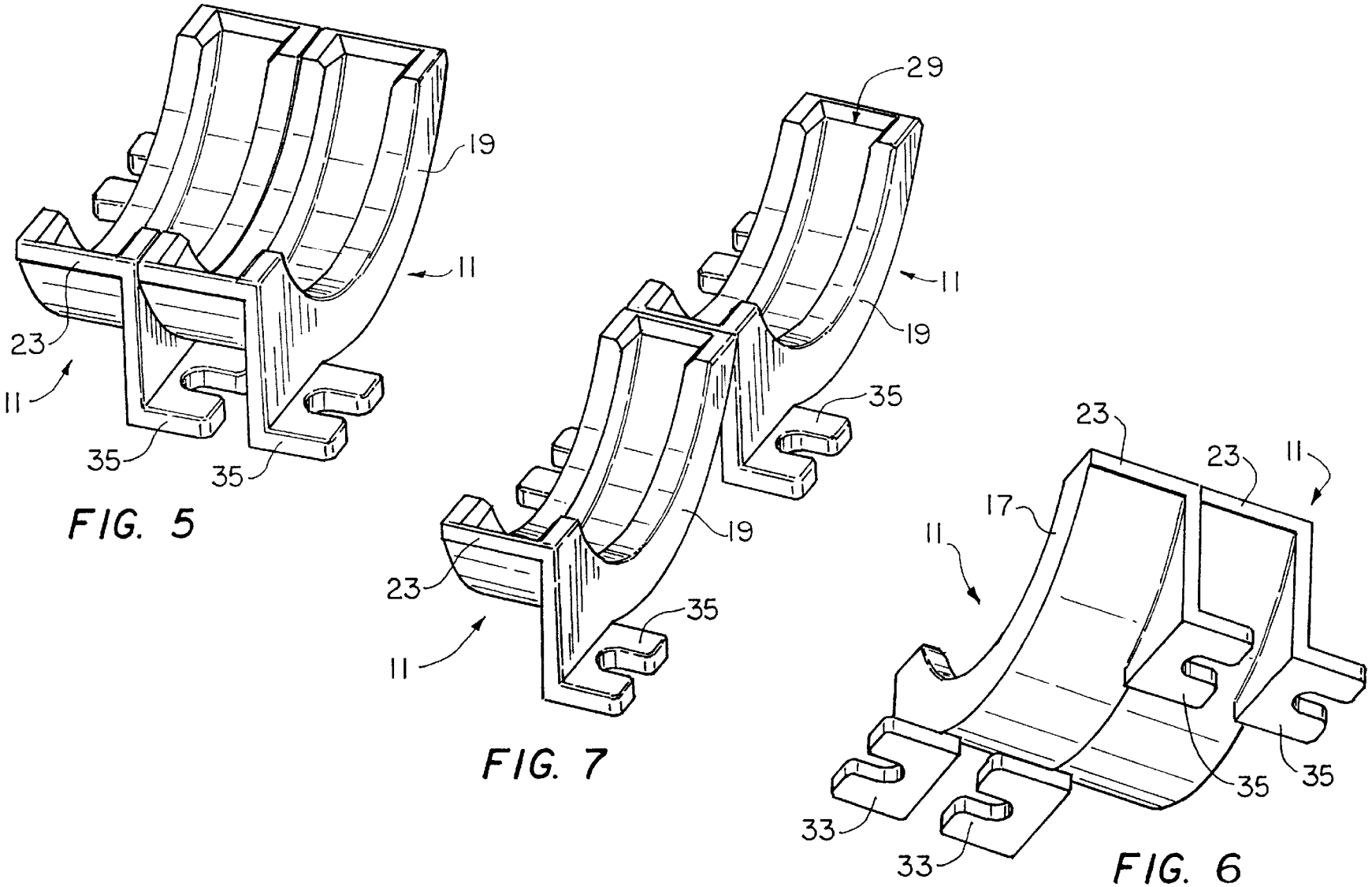
FIG. 5 is a perspective view taken from the top of a pair of the guide tools shown in FIG. 1, the pair of guide tools being shown in a side-to-side relationship.
FIG. 6 is a perspective view taken from the bottom of the pair of guide tools shown in FIG. 5.
FIG. 7 is a perspective view taken from the top of a pair of the guide tools shown in FIG. 1, the pair of guide tools being shown in an end-to-end relationship.

Specifically, as shown in FIGS. 5 and 6, a pair of guide tools 11 can be positioned in side-to-side relationship. In the side-to-side relationship, the pair of guide tools 11 are positioned so that the first side 17 of one guide tool 11 abuts the second side 19 of the other guide tool 11. It should be noted that while in this position, one tab from each guide tool is positioned underneath its adjacent guide tool to create a nesting relationship between the pair of guide tools.

As shown in FIG. 7, a pair of guide tools 11 may also be positioned in an end-to-end relationship. In the end-to-end relationship, the guide tools 11 are positioned so that the first end 21 of one guide tool 11 abuts the second end 23 of the other guide tool 11.

In use, guide tool 11 can be used to install a cable tie C underneath a plurality of wires W positioned on a harness board B. Cable tie C may be any well known cable tie, such as the type having a head H and a tail T, tail T being lockably insertable into head H to form a loop. For example, cable tie C may be of the type described in U.S. Pat. No. 4,473,524 to J.R. Paradis, which is hereby incorporated by reference.

Figure 8:
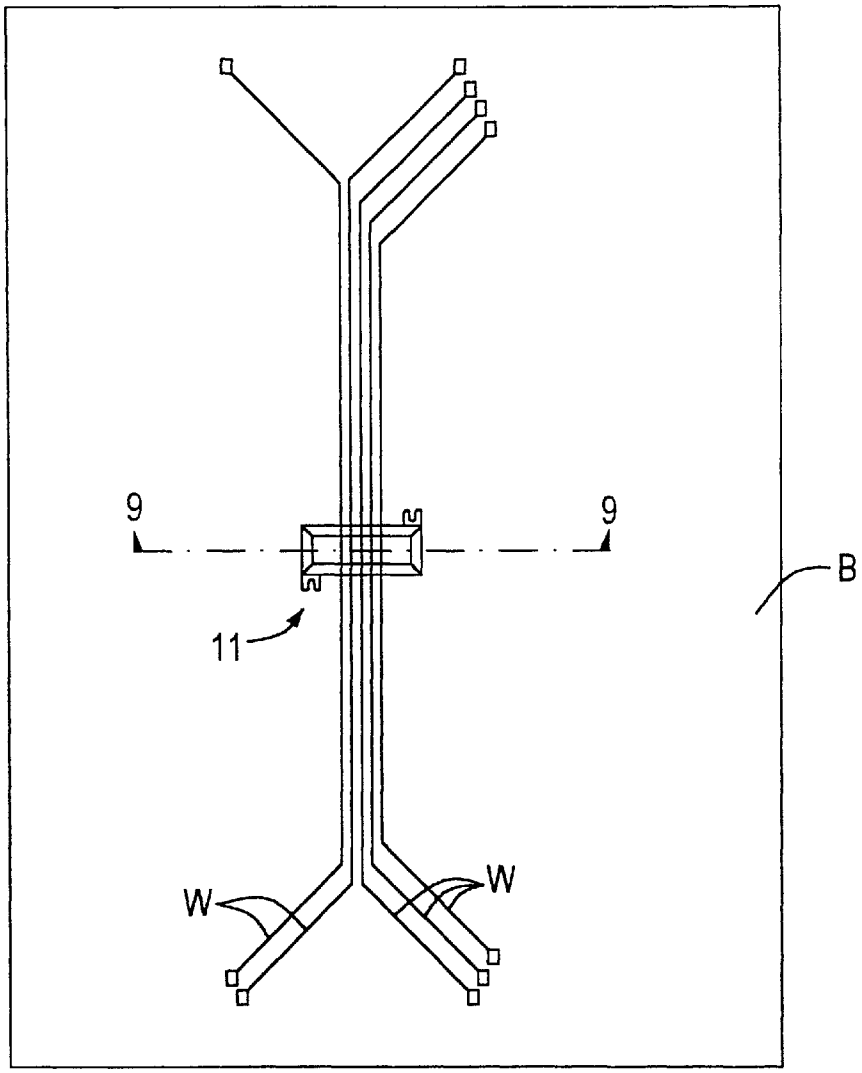
FIG. 8 is a top view of the guide tool shown in FIG. 1, the guide tool being shown mounted on a harness board on which a plurality of wires are disposed.
Figure 9B:
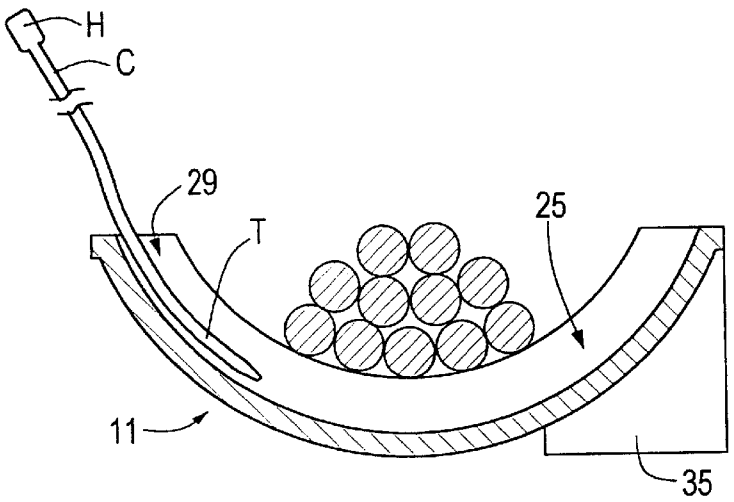
FIGS. 9(*a*)–(*d*) illustrate four steps in guiding a cable tie underneath the plurality of wires seated on the guide tool shown in FIG. 8 taken along lines 9—9, the harness board not being shown.
Figure 9D:
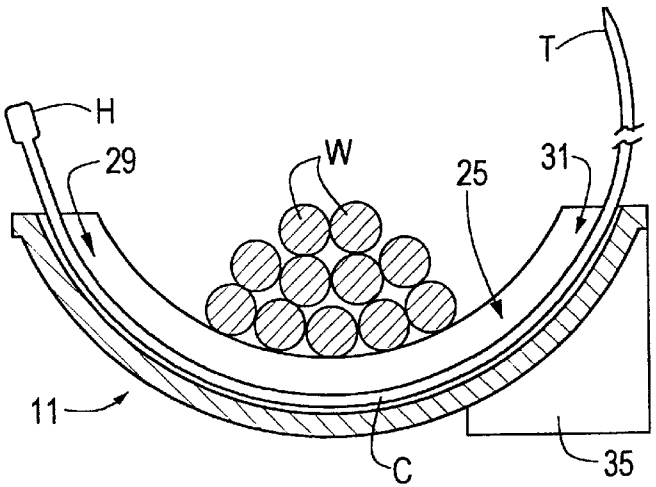
Figure 9A:
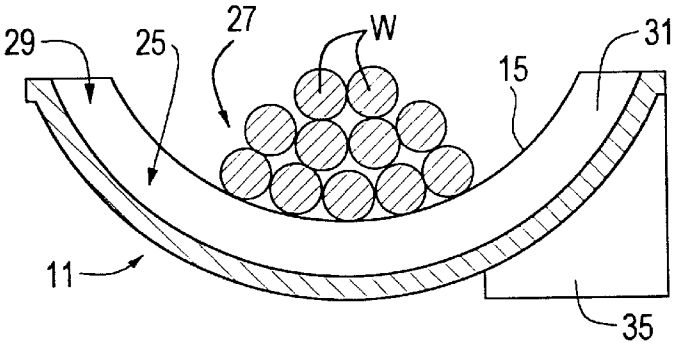
Figure 9C:
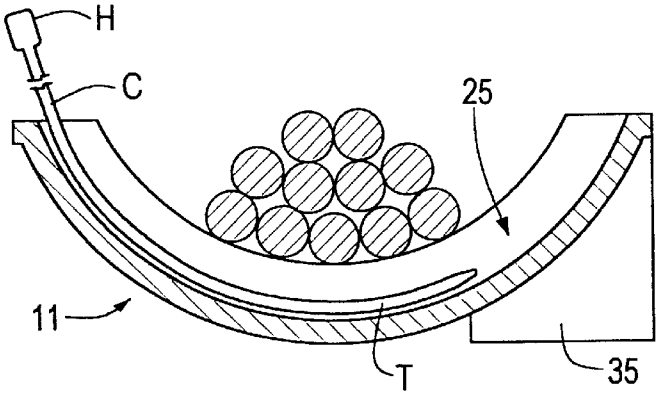

Guide tool 11 is used in the following manner. Guide tool 11 is first mounted on a harness board by inserting a securing device (not shown), such as a pin, through openings 37 and 39 in first and second tabs 33 and 35, respectively, and into the harness board. FIG. 8 shows guide tool 11 mounted on a rectangular harness board B. For simplicity, board B is shown with a single guide tool 11 mounted thereon; however, it is to be understood that numerous guide tools 11 can be mounted on board B to facilitate the wrapping of a plurality of cable ties C around the wires W positioned on the harness board B.

With guide tool 11 mounted on harness board B, wires W are then positioned on harness board B in the configuration in which the wires will be arranged when used in its particular application. In positioning wires W on harness board B, some wires W may pass over the portion of harness board B on which guide tool 11 is mounted. In this situation, wires W are disposed within curved recess 27 with some of wires W seated on top surface of U-shaped top surface 15, as shown in FIG. 9(*a*). It should be noted that the curvature of top surface 15 ensures that wires W remain disposed within recess 27.

With wires W positioned within recess 27, wires W can then be bundled together by feeding cable tie C through guide tool 11. As shown in FIG. 9(*b*), tail T of cable tie C is first manually inserted into elongated slot 25 from entry end 29. Tail T of cable tie C is further manually advanced through elongated slot 25 underneath wires W, as shown in FIG. 9(*c*). Cable tie C is advanced until the free end of tail T projects out through exit end 31, as shown in FIG. 9(*d*). As can be appreciated, elongated slot 25 has a depth sufficient to enable cable tie C to be guided easily underneath wires W without cable tie C contacting the wires seated on top surface 15 of guide tool 11.

With cable tie C guided underneath the wires W disposed within recess 27 and with tail T of cable tie C projecting out through exit end 31, the user can then manually insert tail T through head H of cable tie C. Cable tie C can then be cinched to tightly bundle the plurality of wires W disposed within recess 27 of guide tool 11. As can be appreciated, with a significant number of cable ties C wrapped tightly around wires W at various locations on harness board B, wires W can then be lifted off harness board B while maintaining its initial configuration.

Guide tool 11 is shown being used to facilitate installing a cable tie around a plurality of wires positioned on a harness board; however, it is to be understood that the invention is not exclusively limited to bundling wires, but rather may be used to bundle together other objects, such as cables. In addition, it is to be understood that the invention is not exclusively limited to bundling, but rather may be used to mark objects for identification purposes. Furthermore, it is to be understood that the invention is not exclusively limited to facilitating the installment of a cable tie around wires positioned on a harness board, but rather may be used to install any type of harnessing device, such as a wire, around objects positioned on a flat surface.

Referring now to FIGS. 10–13, there is shown a second embodiment of a guide tool constructed according to the teachings of the present invention, the guide tool being identified generally by reference numeral 41.

Guide tool 41 is similar in construction and use to guide tool 11. Guide tool 41 comprises an elongated, unitary body 43 having a curved top surface 45, a first side 47, a second side 49, a first end 51, a second end 53 and an elongated slot 55. Elongated slot 55 extends down from top surface 45 and includes an entry end 57 at first end 51 and an exit end 59 at second end 53.

Figure 11:
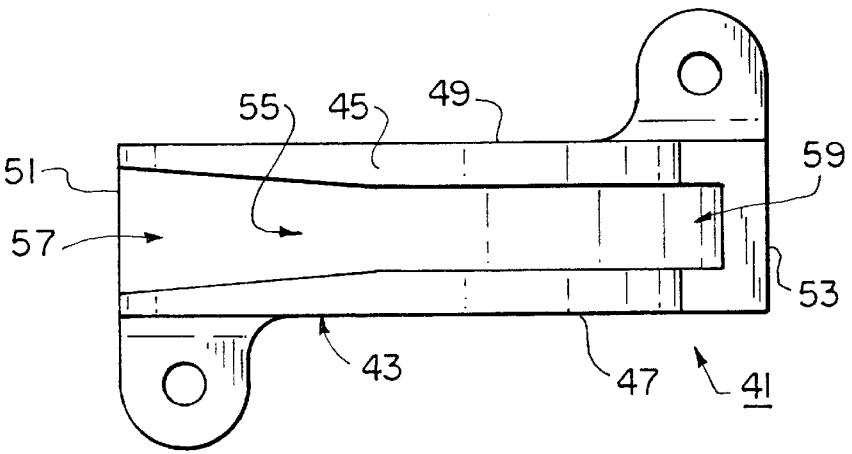
FIG. 11 is a top view of the guide tool shown in FIG. 10.
Figure 12:
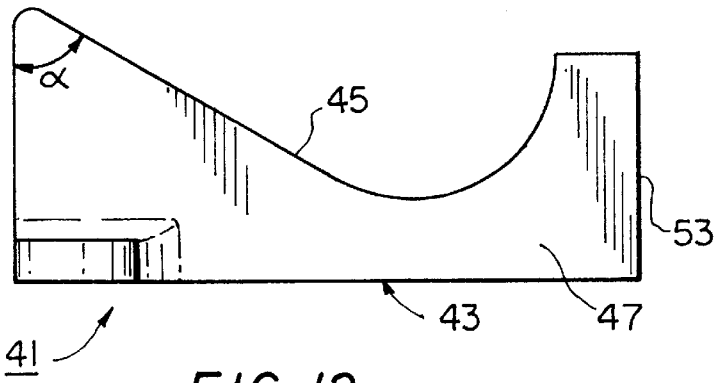
FIG. 12 is a side view of the guide tool shown in FIG. 10.
Figure 10:
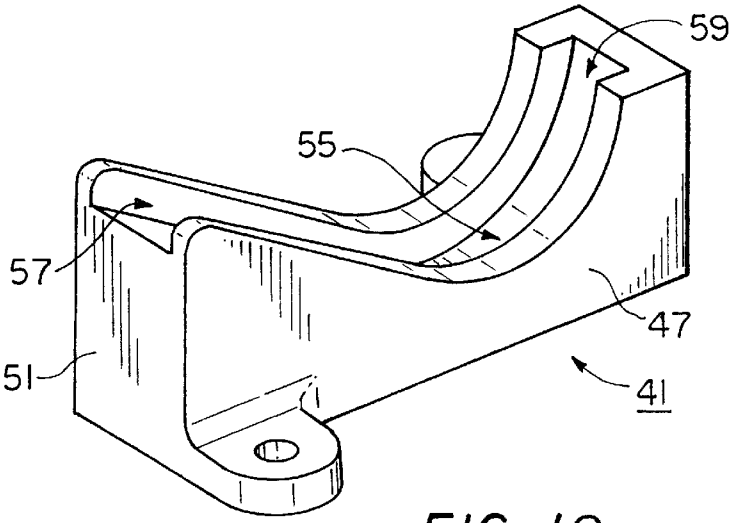
FIG. 10 is a perspective view taken from the top of a second embodiment of a guide tool constructed according to the teachings of the present invention.
Figure 13:
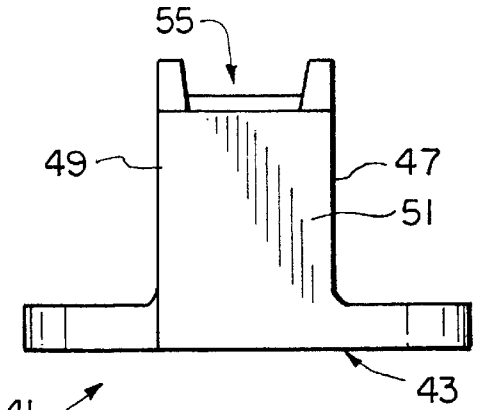
FIG. 13 is an end view of the guide tool shown in FIG. 10.

Entry end 57 of guide tool 41 differs from entry end 29 of guide tool 11. Specifically, as shown in FIG. 12, entry end 57 of elongated slot 55 slopes down in a straight line and has an angle a of approximately 60 degrees. Entry end 57 slopes down linearly to facilitate the ease in which a user can insert a cable tie C into entry end 57 of elongated slot 55. It should be noted that angle $\alpha$ of entry end 57 is not limited to approximately 60 degrees but rather could be increased or decreased without departing from the spirit of the present invention. In addition, it should be noted that exit end 59 of elongated slot 55 could similarly be linearly sloped to facilitate the ease in which a user can guide a cable tie C out through exit end 59. As shown in FIG. 11, entry end 57 of elongated slot 55 also tapers out slightly at first end 51 to facilitate the ease in which a user can insert a cable tie C into entry end 57 of elongated slot 55.

The embodiments shown in the present invention are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A guide tool for use in guiding a harnessing device underneath a plurality of wires disposed on a harness board, the harnessing device being used to form said plurality of wires into a bundle, said guide tool comprising an elongated body generally U shaped in longitudinal cross-section, said elongated body having a top surface on which the plurality of wires can be seated, a pair of sides, a first end, a second end and an elongated slot, the elongated slot extending down from the top surface and having an entry end at the first end of said elongated body and an exit end at the second end of said elongated body, the elongated slot having a depth sufficient to enable said harnessing device to be guided into the elongated slot from the entry end, underneath the plurality of wires and then out through the exit end without slipping out of the slot, the guide tool further including a pair of tabs for mounting said guide tool onto the harness board, one tab being formed and extending out from each of the pair of sides of the elongated body one tab being formed at each end of the elongated body thereof so as to enable a pair of said guide tools to be mounted onto the harness board in an end-to-end relationship in which one end of the elongated body of a first guide tool abuts against one end of the elongated body of a second guide tool and in a side-to-side relation in which one side of the elongated body of a first guide tool abuts against one side of the elongated body of a second guide tool and wherein one tab from each one of said pair of guide tools is positioned underneath the elongated body of the other guide tool to create a nesting relationship between the pair of guide tools.

2. The guide tool as claimed in claim 1 wherein each of said pair of tabs for mounting said guide tool onto the harness board includes a mounting slot for engaging a securing device.

3. The guide tool as claimed in claim 1 wherein said elongated body and said mounting tabs are a unitary structure.

4. A guide tool for use in guiding a harnessing device underneath a plurality of wires disposed on a harness board, the harnessing device being used to form said plurality of wires into a bundle, said guide tool comprising an elongated body having a top surface on which the plurality of wires can be seated, a pair of sides, a first end, a second end and an elongated slot extending down from the top surface, said elongated slot having an entry end at the first end and harnessing device to be guided into the elongated slot from the entry end, underneath the plurality of wires and then out through the exit end without slipping out of the slot, said elongated slot tapering out in width and sloping downward at an angle of about 60 degrees at its entry end to facilitate guiding the harnessing device into the elongated slot of said tool.

5. A guide tool for use in guiding a harnessing device underneath a plurality of wires disposed on a harness board, the harnessing device being used to form said plurality of wires into a bundle, said guide tool comprising an elongated body generally U shaped in longitudinal cross section and having a top surface on which the plurality of wires can be seated, bottom surface, a pair of sides, a first end, a second end and an elongated slot extending down from the top surface into which said harnessing device can be inserted, the guide tool further including a pair of tabs for mounting said guide tool onto the harness board, one tab being formed and extending out from each of the pair of sides, one at each end of said elongated body, whereby a pair of said guide tools can be mounted onto the harness board in an end-to-end relationship in which one end of the elongated body of a first guide tool abuts against one end of the elongated body of a second guide tool and in a side-to-side relation in which one side of said elongated body a first guide tool abuts against one side of second elongated body of a second guide tool so that one tab from each of said pair of guide tools is positioned underneath the bottom surface of the elongated body of the other guide tool to create a nesting relationship between the pair of guide tools.

6. A guide tool for use in guiding a harnessing device underneath a plurality of wires disposed on a harness board, the harnessing device being used to form said plurality of wires into a bundle, said guide tool comprising an elongated body having a top surface on which the plurality of wires can be seated, a substantially arcuately shaped bottom surface, a pair of sides, a first end, a second end and an elongated slot extending down from the top surface, said elongated slot having an entry end at the first end and an exit end at the second end, the elongated slot having a depth sufficient to enable said harnessing device to be guided into the elongated slot from the entry end, underneath the plurality of wires and then out through the exit end without slipping out of the slot, the guide tool further including a pair of tabs for mounting said guide tool onto the harness board, one tab being formed and extending out from each of the pair of sides at each end of said elongated body, said elongated body being shaped so as to enable a pair of said guide tools to be mounted onto the harness board in an end-to-end relationship in which one end of the elongated body of a first guide tool abuts against one end of the elongated body of a second guide tool and in a side-to-side relation in which one side of said elongated body a first guide tool abuts against one side of said elongated body of a second guide tool so that one tab from each of said pair of guide tools is positioned underneath the bottom surface of the elongated body of the other guide tool to create a nesting relationship between the pair of guide tools.

* * * * *